United States Patent [19]

Wettach

[11] 4,336,533

[45] Jun. 22, 1982

[54] FLUID ACTIVATED ALARM DEVICE

[76] Inventor: Robert S. Wettach, 204 N. Main St., Mt. Pleasant, Iowa 52641

[21] Appl. No.: 219,315

[22] Filed: Dec. 22, 1980

[51] Int. Cl.[3] ..... G08B 21/00

[52] U.S. Cl. ..... 340/666; 200/85 R; 340/573; 340/626

[58] Field of Search ..... 340/573, 575, 626, 666; 200/81 R, 85 R, 86 R

[56] References Cited

U.S. PATENT DOCUMENTS

| | | | |
|---|---|---|---|
| 3,727,606 | 4/1973 | Sielaff | 340/626 X |
| 4,020,482 | 4/1977 | Feldl | 340/626 X |
| 4,091,370 | 5/1978 | Swanda | 340/666 X |
| 4,175,263 | 11/1979 | Triplett et al. | 340/666 X |
| 4,195,287 | 3/1980 | McCoy et al. | 340/666 X |
| 4,216,469 | 8/1980 | Airmann et al. | 340/666 |
| 4,228,426 | 10/1980 | Roberts | 340/666 X |

*Primary Examiner*—Thomas A. Robinson
*Assistant Examiner*—Joseph E. Nowicki
*Attorney, Agent, or Firm*—Zarley, McKee, Thomte, Voorhees & Sease

[57] ABSTRACT

A liquid activatable alarm device for providing continuous monitoring of the presence or absence of a patient in a hospital bed. When the patient attempts to leave the bed, a pressure sensitive switch responds sounding an alarm warning the hospital staff.

10 Claims, 5 Drawing Figures

FLUID ACTIVATED ALARM DEVICE

BACKGROUND OF THE INVENTION

This invention relates generally to the continuous monitoring device for maintaining a continuous surveillance of a hospital bed. It allows nurses or other hospital personnel at a remote station to instantly tell when a patient leaves his hospital bed.

Many problems arise when elderly patients are bedridden in hospitals and nursing homes. One particular problem that may often occur, particularly with senile patients or other elderly patients who become disoriented, is that they frequently get out of bed, often with the intent to leave the hospital, and fall and hurt themselves.

The frequency of such accidents is compounded by the fact that hospital personnel are busy and cannot afford to continuously monitor the presence or absence of a single patient in his or her bed. Therefore, there are inevitable times when the patient will be left alone in his room, hoping that he will stay put.

The primary object of the present invention is to provide a monitoring system which will provide continuous surveillance of a hospital bed in order to allow nurses or other staff at a remote station to instantly tell whether the patient is in his bed, or attempting to leave it.

While there have been some such systems developed in the past, for the most part they are extremely expensive and such expenses have been cost-prohibitive in terms of preventing the units from becoming readily commercially available. Unlike those units just referred to, the present unit is simple of construction, inexpensive and easy to install as well as being extremely safe.

An even more specific object of the invention is to provide a liquid activatable alarm pad which activates an alarm when the patient's body pressure against the mattress is no longer present.

An even further object is to provide such a liquid activatable alarm which has a check valve which will prevent activation of the alarm by mere shifting of the patient's body in bed.

An even further object of this invention is to provide a liquid activatable alarm pad which is capable of using the most inexpensive fluid, water, as the pressure responsive liquid.

The means of accomplishing each of these objectives, as well as others, will become apparent from the detailed description of the invention which follows.

SUMMARY OF THE INVENTION

A liquid activatable alarm pad for hospital beds which has a pad containing a flowable liquid such as water, a check valve in communication with an outlet line of the pad to allow free flow of fluid out of the pad, but restricted flow back to the pad, a pressure sensitive switch in fluid communication with the check valve which is normally open and which closes only when pressure against the switch is reduced, with the switch being connected to a circuit and a power source, and the circuit being connected to a signal means which is electrically responsive to reduction in pressure caused by removal of pressure from the pad.

DETAILED DESCRIPTION OF THE INVENTION

Figure 1:
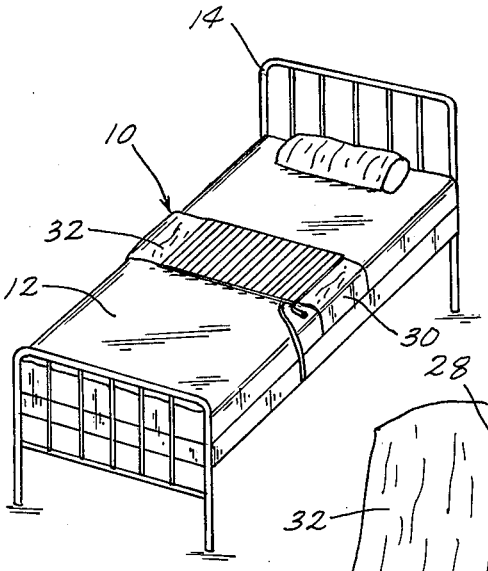
FIG. 1 is an elevated perspective view showing the liquid activatable alarm pad attached to a conventional hospital bed.
Figure 3:
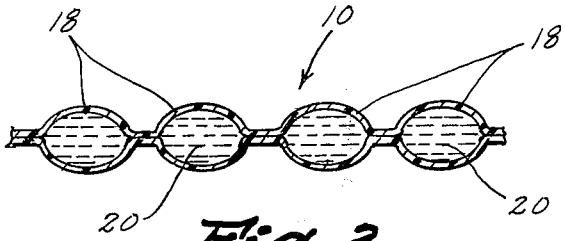
FIG. 3 is a sectional view through the pad along line 3—3.

FIG. 1 is a view showing the alarm pad referred to generally as 10, placed over the mattress 12 of a hospital bed 14. The usual hospital bedding will then be placed over the mattress 12 and pad 10.

Figure 2:
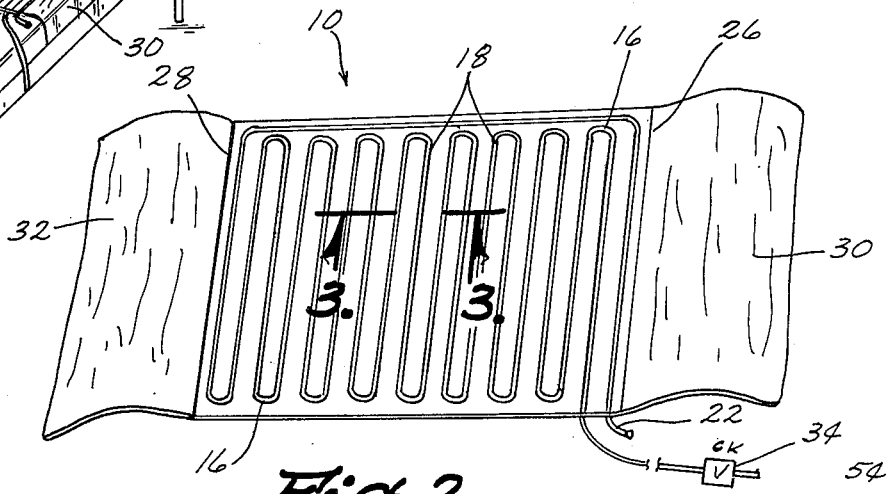
FIG. 2 is a plan view of the pad.

Pad 10 is comprised of a flexible and collapsible material such as polymeric synthetic rubber materials or other suitable polymer plastics. The pad as shown in FIG. 2 is of rectangular dimensions and is constructed in such a manner that it has a convoluted flow path 16 which defines a channel 18 for a flowable liquid such as water 20. In communication with the convoluted flow path 16 is a fluid inlet 22 and correspondingly a fluid outlet line 24.

Attached to the respective sides 26 and 28 are pad flaps 30 and 32. Pad flaps 30 and 32 are used to tuck under mattress 12 in order to securably but releaseably attach pad 10 to mattress 12.

It can thus be seen that when fluid is placed inside of the convoluted path 16 by filling the convoluted path 16 or more accurately, the channels 18 thereof, with, for example water, if pressure is placed on the top surface of the pad 10, the pad will have a tendency to be squeezed, the channels 18 collapsed inwardly and water displaced out of the convoluted pathway 16 into outlet line 24.

Figure 4:
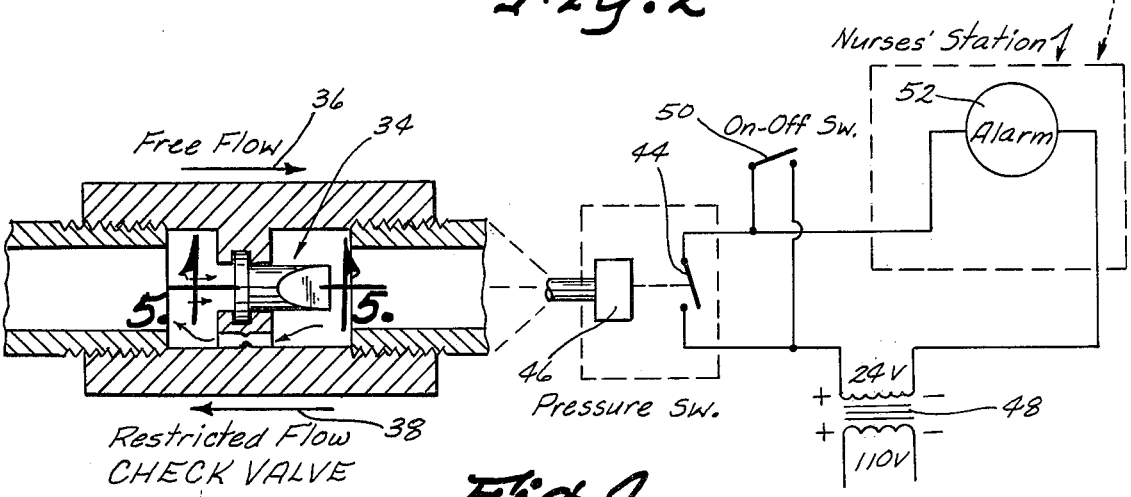
FIG. 4 shows a partial section of the pad outlet line and shows in detail the restricted flow valve, as well as showing the electrical schematic for the device.
Figure 5:
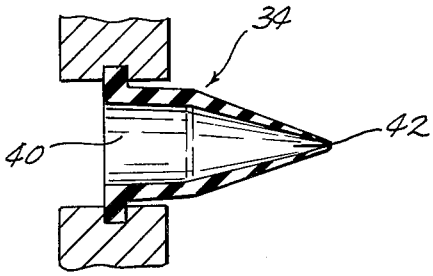
FIG. 5 shows a sectional view along line 5—5 through the duck bill check valve.

Placed on outlet line 24 is a check valve 34, the details of whose construction is best shown in FIGS. 4 and 5.

The check valve 34 allows full free flow of fluid away from the pad as indicated by directional arrow 36. On the other hand, the valve allows only restricted fluid flow back into the pad 10 as indicated by directional arrow 38.

There are numerous available check valves which allow free flow in one direction and restricted flow in another, but one which has been particularly found to be preferable for use in this invention is a duck bill. As best depicted in FIG. 5, the duck bill will accept a full flow into its interior cavity 40 and the pressure opens valve slit 42. The valve itself is constructed of a flexible rubbery material. On the other hand, when there is flow back through the valve in accordance with directional line 38, this slit is in a more collapsed condition and thus the opening not as big, so the flow is restricted, and therefore slower. It is an extremely important part of this invention that a check valve, oriented in the manner as described for full free flow out of the pad and restricted flow back into the pad be used. Such a check valve is necessary in order to prevent undesired activation of the monitoring alarm by mere shifting of body position of a patient in the bed. This will be explained in more detail later.

Positioned on the outlet line downwardly from check valve 34 in full fluid communication with this check valve is a pressure sensitive switch 44. The pressure sensitive switch 44 is shown schematically only, since it is of well known construction. That portion of FIG. 4 in dotted lines surrounding the lead line 44 comprises the pressure sensitive switch. The switch has a diaphragm 46 which is responsive to pressure in pad outlet line 24.

Suitable diaphragm pressure sensitive switches are well known and the precise construction of the switch is not critical. One which has been found very satisfactory in operation is manufactured by Garretson Equipment Company, Inc. of Mt. Pleasant, Iowa, sold under the number 351-01, and 351-02 Vacuum Switches. Literature concerning these switches is available from the company. The pressure switch is one which is normally open, it being urged open by the liquid pressure against diaphragm 46 which is, of course, caused by the body weight of the patient lying on pad 10. This pushes fluid out of the pad into outlet line 24 and against diaphragm 46, urging the switch 44 to its normally open position depicted in FIG. 4. When the diaphragm pressure is relieved by the patient getting up out of bed, the pressure is maintained for a certain period of time because of the restricted flow in the direction indicated by arrow 38, but eventually the pressure is released, diaphragm 46 moves and pressures switch 44 closes, energizing the electrical circuitry. The circuit is shown in schematic in FIG. 4, and as can be seen, it has a power source 48 which is electrically associated with pressure switch 44. Also shown in the circuit is a manual override on-off switch 50, and a signal alarm means 52, which is shown in FIG. 4 as positioned remotely from the hospital bed in, for example, a nurse's station 54.

In actual operation, the unit works as follows: The pad 10 is filled with water and placed on the hospital bed as depicted in FIG. 1. When the patient is lying on the bed, the walls of the convoluted pathway 16 are collapsed, displacing water out of the channels 18 and into outlet line 24. The check valve 34 on outlet line 24, allows full and free flow in the direction indicated by arrow 36 against diaphragm 46. This pressure urges the pressure sensitive switch 44 normally open, and therefore the alarm is not activated. However, if the patient should get up from the pad, assuming of course, manual override switch 50 is closed, there is a slight delay before anything occurs. This delay is desirable and is designed by use of the check valve 34. The delay is caused because of the restricted flow back indicated by directional arrow 38 which therefore maintains the pressure in the line for a short period of time, perhaps a few seconds. Then the pressure is relieved, diaphragm 46 moves, and pressure sensitive switch 44 closes, energizing the circuit. The signal alarm 52 in the nurses' station 54 is activated, indicating the patient has moved off the pad in an attempt to leave the bed. The alarm 52 continues until someone from the nurses' station goes down to the patient's room and shuts off the manual override switch 50. The alarm 52 may, of course, be either an audible alarm or a flashing light alarm at the choice of the user.

Certain other items of construction are worthy of note. It has been found desirable to have the manual override switch located remote from the nurses' station and in the patient's room or very near the room, which therefore mandates that someone from the nurses' station has to come to the patient's room in order to shut off the alarm. This makes it very difficult to ignore the alarm. The pad itself can be easily made by modification of a currently available warm water pad. One which has been found very acceptable is a pad sold under the trademark Aquamatic which is designed to hold hot water. The pad is available from Hamilton Industries of 5500 Muddy Creek Road, Cincinnati, Ohio.

As explained earlier, the operation of the check valve is critical to the invention. If the patient merely shifts his weight in the bed, there will be a decrease in pressure, but it will not last long enough for the alarm to be activated. This is because of the restricted flow back through the valve indicated by directional arrow 38. This few second delay before activation will allow the patient to shift body weight without alarm activating.

It can therefore be seen that a highly successful, inexpensive but efficient, continuous patient monitoring device has been developed.

What is claimed is:

1. A liquid activatable alarm pad for a hospital bed comprising:

a flexible pressure sensitive pad having means for containment of a flowable liquid, a liquid inlet and a liquid outlet line, a check valve in communication with said outlet line, allowing free flow of said fluid out of said pad through said outlet line but restricted flow back through said outlet line to said pad, a pressure sensitive switch in fluid communication with said check valve, said switch being normally open, and closing only when pressure against said switch is reduced, said switch being connected to a circuit and a power source, and said circuit being connected to a signal means which is electrically responsive to reduction in pressure caused by removal of pressure from said pad.

2. The device of claim 1 wherein said check valve is a duck bill valve.

3. The device of claim 1 wherein said pressure sensitive switch is a diaphragm pressure switch.

4. The device of claim 1 wherein said pad has a series of fluid flow channels extending throughout said pad.

5. The device of claim 1 wherein said pad has a pair of side flaps, one attached to each side of said pad, for releasable securement of said pad to a hospital bed.

6. The device of claim 1 wherein said signal means is an audible alarm.

7. The device of claim 1 wherein said signal means is a visual alarm.

8. The device of claim 1 where said signal means is located at or near a nurses' station.

9. The device of claim 1 wherein said flowable liquid is water.

10. The device of claim 1 wherein said circuit includes a manual override switch.

* * * * *